US007798672B2

(12) United States Patent
Routledge

(10) Patent No.: US 7,798,672 B2
(45) Date of Patent: Sep. 21, 2010

(54) SEALED LED LIGHT FIXTURE INCLUDING DUAL LAYER GLASS SHEET

(75) Inventor: Gordon Routledge, Knaresborough (GB)

(73) Assignee: Dialight Lumidrives Limited, Huntingdon, Cambridgeshire (GB)

( * ) Notice: Subject to any disclaimer, the term of this patent is extended or adjusted under 35 U.S.C. 154(b) by 232 days.

(21) Appl. No.: 11/795,927

(22) PCT Filed: Jan. 17, 2006

(86) PCT No.: PCT/GB2006/000167

§ 371 (c)(1),
(2), (4) Date: May 8, 2008

(87) PCT Pub. No.: WO2006/077400

PCT Pub. Date: Jul. 27, 2006

(65) Prior Publication Data

US 2008/0212316 A1 Sep. 4, 2008

(30) Foreign Application Priority Data

Jan. 24, 2005 (GB) ..... 0501309.9

(51) Int. Cl.
*F21V 3/04* (2006.01)
*F21S 4/00* (2006.01)

(52) U.S. Cl. ..... 362/249.02; 362/311.02; 362/311.05; 362/240; 362/97.3

(58) Field of Classification Search ..... 362/249.02, 362/240, 236, 362, 225, 545, 544, 800, 311.02, 362/311.05
See application file for complete search history.

(56) References Cited

U.S. PATENT DOCUMENTS

| | | | | | |
|---|---|---|---|---|---|
| 1,678,351 | A | * | 7/1928 | Payne | 362/362 |
| 4,271,408 | A | * | 6/1981 | Teshima et al. | 345/83 |
| 4,733,335 | A | * | 3/1988 | Serizawa et al. | 362/503 |
| 4,935,665 | A | * | 6/1990 | Murata | 362/545 |
| 4,975,814 | A | * | 12/1990 | Schairer | 362/240 |
| 4,977,695 | A | * | 12/1990 | Armbruster | 40/541 |
| 5,241,457 | A | * | 8/1993 | Sasajima et al. | 362/503 |
| 5,249,104 | A | * | 9/1993 | Mizobe | 362/605 |
| 5,632,551 | A | * | 5/1997 | Roney et al. | 362/485 |
| 5,765,940 | A | * | 6/1998 | Levy et al. | 362/240 |

(Continued)

FOREIGN PATENT DOCUMENTS

DE 202004013308 U1 11/2004

(Continued)

OTHER PUBLICATIONS

International Search Report and Written Opinion of the International Searching Authority, mailed May 2, 2006, for corresponding International Application No. PCT/GB2006/000167.

(Continued)

*Primary Examiner*—Ismael Negron
(74) *Attorney, Agent, or Firm*—Klarquist Sparkman, LLP

(57) ABSTRACT

An illumination apparatus includes a lamp housing defining a cavity, a plurality of light emitting diodes disposed within the cavity, a first inner glass sheet for sealing the cavity, a second outer glass sheet, and a resilient layer formed between the glass sheets.

17 Claims, 2 Drawing Sheets

U.S. PATENT DOCUMENTS

| | | | | |
|---|---|---|---|---|
| 5,934,798 | A * | 8/1999 | Roller et al. | 362/497 |
| 6,764,210 | B2 * | 7/2004 | Akiyama | 362/541 |
| 2007/0139913 | A1 | 6/2007 | Savage | |

FOREIGN PATENT DOCUMENTS

| | | | |
|---|---|---|---|
| EP | 1267029 | A | 12/2002 |
| EP | 1371896 | A | 12/2003 |

OTHER PUBLICATIONS

International Preliminary Report on Patentability and Written Opinion of the International Searching Authority, mailed Aug. 2, 2007, for corresponding International Application No. PCT/GB2006/000167.

* cited by examiner

SEALED LED LIGHT FIXTURE INCLUDING DUAL LAYER GLASS SHEET

CROSS REFERENCE TO RELATED APPLICATIONS

This is the U.S. National Stage of International Application No. PCT/GB2006/000167, filed Jan. 17, 2006, which in turn claims the benefit of Great Britain Application No. GB0501309.9, filed Jan. 24, 2005.

The present invention relates to apparatus for providing illumination and a method for manufacturing the apparatus. In particular, but not exclusively, the present invention relates to a light fixture in which a plurality of light emitting diodes are held in a lamp housing, the lamp housing is sealed to provide a secure enclosure for protecting the light emitting diodes.

Light emitting diode (LED) lighting technology offers significant advantages over traditional light sources such as incandescent, fluorescent or high intensity discharge (HID) lamps. A key advantage is the long life which can easily exceed 50,000 hours. With a longer life a fixture in which the light source is housed must be developed to provide a mechanical housing for securely containing the LED's which is able to withstand environmental pressures for at least as long as the LED's.

Traditionally the need to design a light fixture to enable maintenance to be possible has caused problems for the life of the light fixture. An access door or port has been needed to enable a qualified user to replace broken or exhausted light elements. Screws for holding the door in a closed position may be lost or incorrectly tightened and gaskets providing a seal to the light fixture can become worn or trapped. This has reduced the ingress protection rating leading to water or condensation gathering within a fixture.

It is an aim of the present invention to at least partly mitigate the above-mentioned problems.

It is an aim of embodiments of the present invention to provide a lamp fixture which seals LED's in a cavity of a lamp housing in such a way that ingress protection can be guaranteed for a prolonged period of time.

It is an aim of embodiments of the present invention to provide a method of manufacturing a light fixture which may be carried out efficiently and which results in a secure housing for LED's.

According to a first aspect of the present invention there is provided apparatus for providing illumination, comprising:

a lamp housing defining a cavity;

a plurality of light emitting diodes (LED's) disposed within said cavity; and sealing means, comprising a first glass sheet, for sealing the cavity.

According to a second aspect of the present invention there is provided a method for providing a light fixture, comprising the steps of:

providing a lamp housing defining a cavity;

mounting a plurality of LED's at a bottom surface of said housing in said cavity; and sealing said cavity via at least one glass sheet.

Embodiments of the present invention provide the advantage that LED's are housed in a sealed unit. The seal ensures that the LED's are protected from ingress of water or other contaminants for a prolonged period of time.

Embodiments of the present invention provide a sealed for life construction which obviates the need for users to carry out maintenance of the light fixture.

Embodiments of the present invention will now be described hereinafter, by way of example only, with reference to the accompanying drawings in which.

In the drawings like reference numerals refer to like parts.

Figure 1:
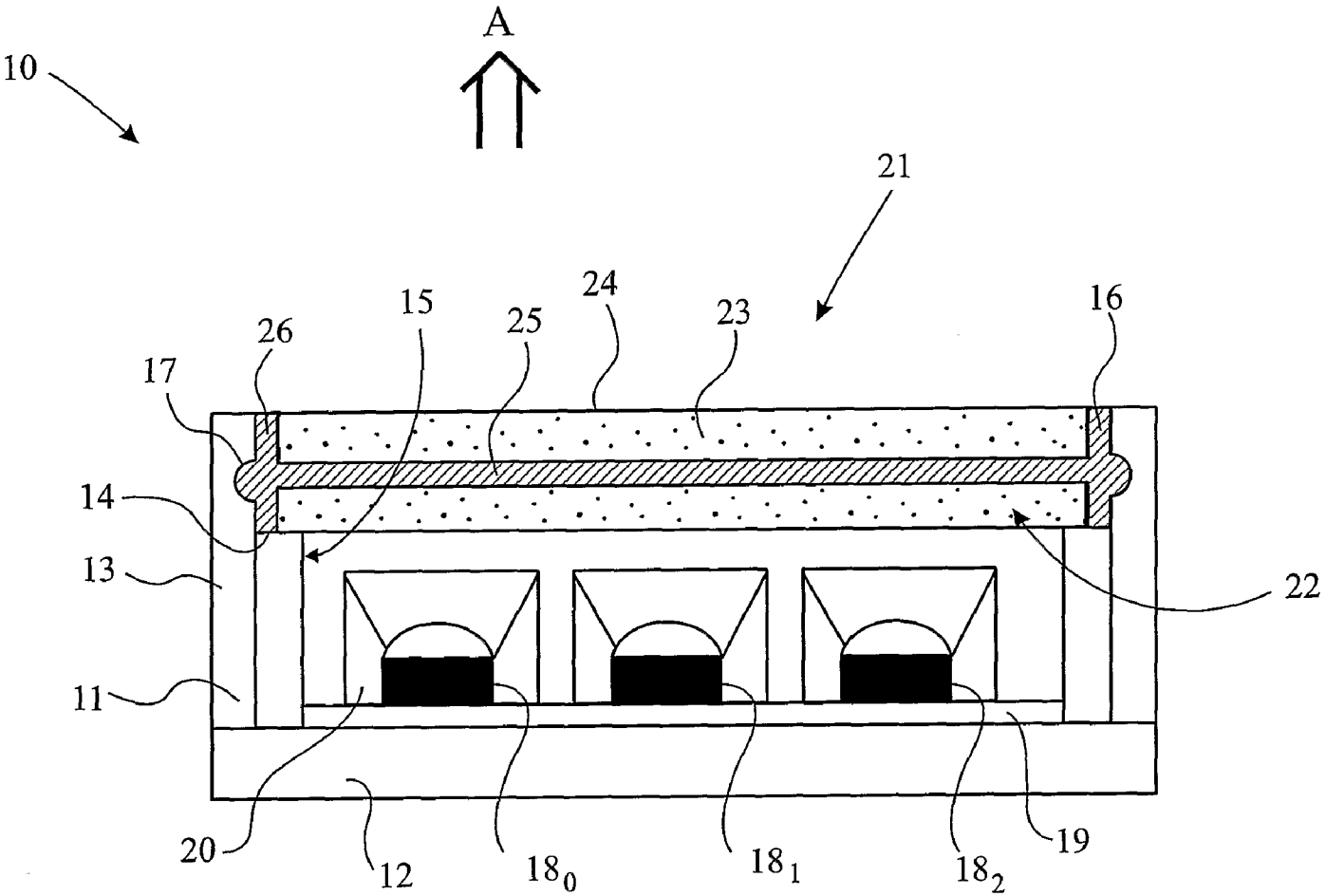
FIG. 1 illustrates a light fixture.

FIG. 1 illustrates a light fixture 10 in accordance with an embodiment of the present invention. The light fixture 10 includes a housing 11 having a base 12 and an upright wall 13 which extends upwardly from the edge of the base 12. The housing may be circular, square or any other shape. The base and wall may be separately or integrally formed. The upright wall is stepped at a point 14 around two thirds of the distance upwards from the base. An inner surface 15 of a lower portion of the wall defines a first portion of the cavity provided by the interior of the open-mouthed housing. The first portion of this cavity has a cross section defined by the internal surface 15 of the wall 13. A second internal surface 16 above the step defines a further portion of the cavity. Because the internal surface 16 is set back with respect to the internal surface 15 the cavity defined by this internal surface has a greater cross section than the cavity portion defined by the internal surface 15. The whole cavity defined by the housing 11 is provided by both cavity portions.

A groove 17 extends around the internal surface 16. This may extend all the way around the housing or for only a part of the housing.

Three LED's $\mathbf{18}_0$ to $\mathbf{18}_2$ are located at a bottom portion of the housing and are secured to the housing via a mounting block 19. Each LED has a respective focusing lens 20 disposed proximate to it to select a light profile determining how illumination is provided by the LED's.

The LED's are sealed in the housing by a seal 21 provided by an inner glass plate 22 which is located on the stepped region 14 of the wall and a further outer glass sheet 23. The outer surface 24 of the outer glass sheet 23 provides a wear resistant surface which prevent ingress of water and other contaminants into the cavity housing. The seal 21 also includes a layer 25 of resilient material such as resin. Preferably a polyurethane resin is used. The inner glass sheet 22 and outer glass sheet 23 have a cross section which is less than the cross section defined by the inner surface 16 of the upper portion of the housing wall 13. Because of this resin is also located around the glass sheets in a region 26 between the outer peripheries of the glass sheet and the inner surface 16 of the upper part of the housing. Resin also is located in the grooves 17. Because of the resin in the grooves movement of the seal in the direction of arrow A in FIG. 1, and thus away from the housing, is prevented.

Figure 2A:
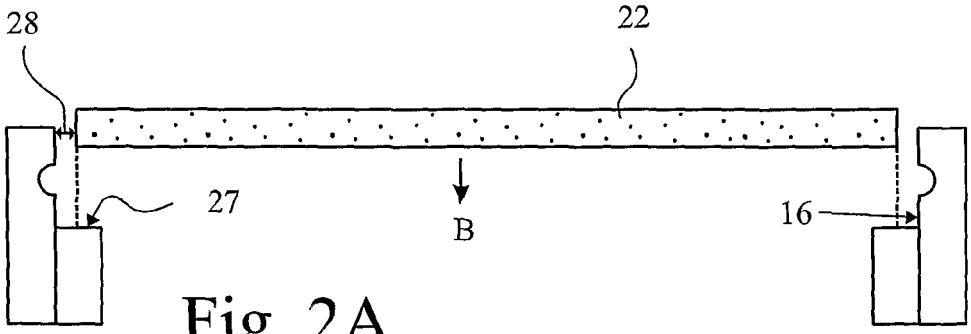
FIG. 2 illustrates a method for manufacturing a light fixture.

FIG. 2 illustrates a method by which the light fixture 10 may be prepared. FIG. 2A illustrates the upper portion of the housing 11. It will be understood that prior to the steps illustrated in FIG. 2 the LED's are mounted in the cavity of the housing so as to be in a position to be sealed-in. For providing the seal the first glass sheet 22 is located so as to rest on an upper surface 27 of the housing where the housing is stepped. As an alternative the first layer of glass 22 could be slid within an extrusion profile. The cross section of the glass layer 22 is such that a space 28 is left surrounding the outer extreme surfaces of the glass and the inner surface 16 of the upper part of the housing wall. The lower glass sheet could alternatively substantially fit flush with the inner surface 16 of the housing.

Figure 2B:
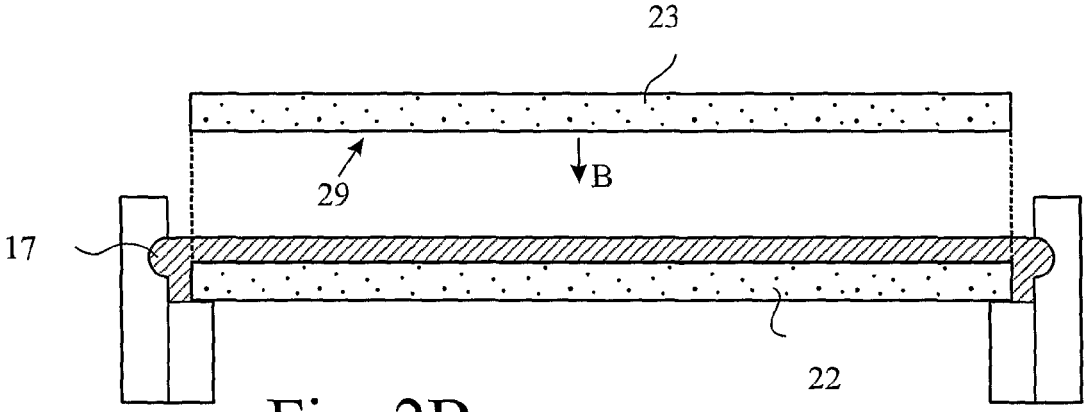
Figure 2C:
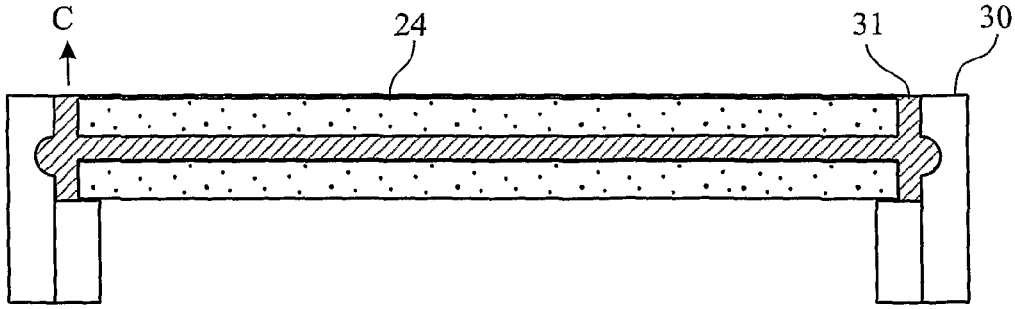

FIG. 2B illustrates a next step in which a resilient material such as a clear resin is poured over the glass layer 22. The resin layer is shown is oversized for clarity and will preferably have a thickness of 0.1 to 0.5 millimetres. The resin layer preferably remains slightly flexible even after setting which makes the whole glass and resin seal structure more resistant to impact. The resin layer can incorporate a UV filter which will reduce the effect of strong sunlight on any plastic part used for the LED and optical system. For example, the whole housing may be made of plastic. In this way the effects of UV which tends to discolour and degrade the mechanical properties of plastic parts is minimised. The resin may also or alternatively include an infra-red (IR) filter component. The infra-red filter will reduce the effects of self heating of the light fixture 10 when subject to strong sunlight. As the resin is poured over the first glass sheet it will key into the groove 17 provided in the housing wall. This prevents movement of the seal. Whilst the resin is still soft the further outer glass sheet 23 is pressed downwardly in the direction of arrow B in FIG. 2B so that a lower surface 29 is urged into the resin material. This process tends to thin the resin material and causes further resin to move upwardly in the direction of arrow C illustrated in FIG. 2C in the space 28 surrounding the upper glass sheet and the inner surface 16 of the upper part of the housing. When the optically clear resin sets the two pieces of glass and sandwiched resin layer appear to be one unit. If the space between the glass layer and the rim 30 of the light housing are not filled with resin by this stage these regions may be topped up so that an upper surface of the light fixture is then provided by the upper surface 24 of the outer glass sheet, an upper surface 31 of the resin layer and the rim 30 of the housing. Use of an outer glass sheet is particularly preferable because glass tends to be self cleaning when subject to rain. In this way if the light housing is located outside the housing will tend to remain clear and not collect dirt. Alternatively plastic sheets may be used instead of glass. The glass or plastic sheets may be transparent, translucent or coloured.

It will be appreciated that once the open mouth of the light housing is sealed by the resin and glass sheet sandwich the LED's are sealed for life. The cavity space remaining may be filled with air or some other inert gas. Using a glass/resin sandwich means that the final construction is stronger than if a single glass sheet were used since if the outer (or inner) glass sheet is broken there will be a tendency to stick together. This has an advantage in safety critical applications or in areas subject to vandalism.

Written information such as instructions or advertising may be sandwiched between the inner and outer sheets or etched into a surface of one of the sheets.

Embodiments of the present invention have been described hereinabove by way of example only. It would be understood that modifications may be made to the specifically described features without departing from the scope of the present invention.

The invention claimed is:

1. Apparatus for providing illumination, comprising:

a lamp housing defining a cavity;

a plurality of light emitting diodes (LED's) disposed within said cavity; and sealing means, comprising a first glass sheet, for sealing the cavity;

said sealing means further comprising an outer glass sheet and a resilient layer located between said first glass sheet and said outer glass sheet.

2. The apparatus as claimed in claim 1 wherein said apparatus comprises a light fixture.

3. The apparatus as claimed in claim 1 wherein said LED's are high power LED's.

4. The apparatus as claimed in claim 1 wherein at least an upper region of said LED's are surrounded by air.

5. The apparatus as claimed in claim 1 wherein at least an upper region of said LED's are surrounded by an inert gas.

6. The apparatus as claimed in claim 1 wherein said resilient layer is a resin layer.

7. The apparatus as claimed in claim 6 wherein said resin layer comprises a UV filter.

8. The apparatus as claimed in claim 1 wherein said cavity comprises:

a first cavity portion having a first cross section and a second cavity portion located above said first cavity portion and having a cross section greater than said first cavity portion.

9. The apparatus as claimed in claim 8 wherein said first glass sheet has a cross section greater than said first cross section and is located to cover an open mouth portion of said first cavity portion.

10. The apparatus as claimed in claim 9 wherein said first glass sheet has a cross section less than a cross section of said second cavity portion.

11. The apparatus as claimed in claim 1 wherein said lamp housing comprises:

a base portion having a peripheral edge region extending around the whole outer edge of the base portion;

an upright wall portion extending upwardly from said peripheral edge region; wherein an internal surface of said wall portion is stepped, a lower surface of said wall having a smaller internal cross section than an upper internal cross section.

12. The apparatus as claimed in claim 11 wherein said wall portion has an upper rim defining an open mouth of said housing.

13. The apparatus as claimed in claim 11 further comprising an internal groove extending along a region of the inner surface of said wall portion.

14. The apparatus as claimed in claim 13 wherein a portion of said resilient layer is held in said groove to prevent movement of said sealing means away from said lamp housing.

15. A method for providing a light fixture, comprising the steps of:

providing a lamp housing defining a cavity;

mounting a plurality of LED's at a bottom surface of said housing in said cavity; and sealing said cavity via at least one glass sheet;

wherein the step of sealing comprises:

covering a lower cavity region of said cavity with a first glass sheet;

subsequent to said step of covering said lower cavity region, depositing a resilient material over said first glass sheet;

locating a second glass sheet on a resilient layer generated by said step of depositing resilient material.

16. The method as claimed in claim 15 further comprising the steps of:

depositing further resilient material around an outer edge region of said outer glass sheet.

17. The method as claimed in claim 15 wherein said step of sealing said cavity comprises irreversibly sealing said cavity.

* * * * *